US010688526B2

(12) United States Patent
Tani et al.

(10) Patent No.: US 10,688,526 B2
(45) Date of Patent: Jun. 23, 2020

(54) ELECTROSTATIC ATOMIZING COATING APPARATUS AND COATING METHOD

(71) Applicant: TOYOTA JIDOSHA KABUSHIKI KAISHA, Toyota-shi, Aichi-ken (JP)

(72) Inventors: Shinji Tani, Miyoshi (JP); Astuo Nabeshima, Okazaki (JP); Takahito Kondo, Nisshin (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 15/235,543

(22) Filed: Aug. 12, 2016

(65) Prior Publication Data

US 2017/0056901 A1 Mar. 2, 2017

(30) Foreign Application Priority Data

Aug. 28, 2015 (JP) ..... 2015-169455

(51) Int. Cl.
*B05D 1/04* (2006.01)
*B05B 5/00* (2006.01)
(Continued)

(52) U.S. Cl.
CPC ..... *B05D 1/04* (2013.01); *B05B 5/005* (2013.01); *B05B 5/043* (2013.01); *B05B 5/0407* (2013.01);
(Continued)

(58) Field of Classification Search
CPC ..... B05C 19/04; B05C 19/008; B05C 19/00; B05C 11/1018; B05D 1/04; B05B 5/043; B05B 5/005; B05B 5/0407; B05B 5/0426; B05B 5/0415; B05B 5/1683; B05B 5/0418; B05B 5/081
(Continued)

(56) References Cited

U.S. PATENT DOCUMENTS 3,083,121 A * 3/1963 Gauthier ..... B05B 5/10 101/DIG. 37
3,512,502 A * 5/1970 Drum ..... B05B 3/1064 118/624
(Continued)

FOREIGN PATENT DOCUMENTS

EP 0847807 A2 * 6/1998
JP S56-045778 A 4/1981
(Continued)

*Primary Examiner* — Laura Edwards
(74) *Attorney, Agent, or Firm* — Oliff PLC

(57) ABSTRACT

An electrostatic atomizing coating apparatus and method incorporate a rotary head having a base portion, an open end and a plurality of grooves formed radially on an inner peripheral surface of the open end, an inside diameter of the rotary head increasing from the base portion toward the open end, and a motor configured to rotate the rotary head to discharge a thread-shaped paint. A voltage is applied to the rotary head so as to form an electrostatic field between the open end of the rotary head and an earthed coating target and to electrostatically atomize the thread-shaped paint discharged from the open end. Voltage output from the generator is controlled so as to adjust an intensity of the electrostatic field and to control a particle diameter of the electrostatically atomized thread-shaped paint.

17 Claims, 18 Drawing Sheets

(51) Int. Cl.

| | |
|---|---|
| ***B05B 5/04*** | (2006.01) |
| ***B05B 5/043*** | (2006.01) |
| ***B05B 5/08*** | (2006.01) |
| ***B05C 11/10*** | (2006.01) |
| ***B05C 19/04*** | (2006.01) |
| ***B05C 19/00*** | (2006.01) |

(52) U.S. Cl.
CPC ..... *B05B 5/0418* (2013.01); *B05B 5/081* (2013.01); *B05C 11/1018* (2013.01); *B05C 19/008* (2013.01); *B05C 19/04* (2013.01); *B05B 5/0426* (2013.01)

(58) Field of Classification Search
USPC ..... 118/629, 663–712; 427/474, 475, 479, 427/480; 239/690–708
See application file for complete search history.

(56) References Cited

U.S. PATENT DOCUMENTS 4,495,086 A * 1/1985 Hiroshima ..... B01F 3/0807 366/165.4
5,218,305 A * 6/1993 Lunzer ..... B05B 5/0532 239/690
5,397,063 A 3/1995 Weinstein
7,384,670 B2 * 6/2008 Tani ..... B05B 3/1014 239/1
8,794,177 B2 * 8/2014 Shigekura ..... B05B 3/02 118/323
2007/0240641 A1 * 10/2007 Lind ..... B05B 3/1042 118/308
2009/0140083 A1 6/2009 Seitz
2009/0229517 A1 * 9/2009 Ko ..... B05B 5/032 118/696
2010/0145516 A1 * 6/2010 Cedoz ..... B05B 5/025 700/258
2014/0255614 A1 9/2014 Myers et al.

FOREIGN PATENT DOCUMENTS

JP S58-030327 A 2/1983
JP H06-091205 A 4/1994
JP H08-10659 A 1/1996
JP H08-108106 A 4/1996
JP H10-052657 A 2/1998
JP 2002-119894 A 4/2002
JP 2009-045518 A 3/2009
WO 2010/006641 A1 1/2010

* cited by examiner

ELECTROSTATIC ATOMIZING COATING APPARATUS AND COATING METHOD

INCORPORATION BY REFERENCE

The disclosure of Japanese Patent Application No. 2015-169455 filed on Aug. 28, 2015 including the specification, drawings and abstract is incorporated herein by reference in its entirety.

BACKGROUND

1. Technical Field

This application relates to an electrostatic atomizing coating apparatus and a coating method thereof.

2. Description of Related Art

A general rotary atomizing coating apparatus sprays shaping air on a thread-shaped water-based paint discharged from a bell-shaped rotary head that rotates at a high speed, so as to atomize the thread-shaped water-based paint and to control a coating pattern. However, in the rotary atomizing coating apparatus, an accompanied flow of the shaping air is returned back by a coating target to raise up coating particles, which may cause such a possibility that coating efficiency decreases.

A solution to such a possibility is disclosed in Japanese Patent Application Publication No. 8-108106 (JP 8-108106 A). A coating apparatus disclosed in JP 8-108106 A realizes atomization of a paint without using shaping air such that a rotation speed of a rotary head (a cup-type main electrode) is increased to increase a centrifugal force.

However, even if the rotation speed of the rotary head is just increased without using shaping air like the coating apparatus disclosed in JP 8-108106 A, the paint cannot be atomized sufficiently to a particle diameter suitable for the application. As a result, there is a possibility that the paint cannot be applied to a coating target efficiently.

SUMMARY

The disclosed embodiments provide an electrostatic atomizing coating apparatus and a coating method thereof each of which is able to apply a paint to a coating target by atomizing the paint without using shaping air.

In a first embodiment, there is provided an electrostatic atomizing coating apparatus comprising at least one rotary head having a base portion, an open end and a plurality of grooves formed radially on an inner peripheral surface of the open end, an inside diameter of the rotary head increasing from the base portion toward the open end, a motor configured to rotate the at least one rotary head to discharge a thread-shaped paint from the open end, a generator configured to provide a voltage to the at least one rotary head so as to form an electrostatic field between the open end and a grounded coating target and electrostatically atomize the thread-shaped paint discharged from the open end, and a controller configured to control a voltage output from the generator so as to adjust an intensity of the electrostatic field and control a particle diameter of the electrostatically atomized thread-shaped paint. This makes it possible to atomize the paint to a particle suitable for the application without using shaping air. Hereby, paint particles attached to the coating target and paint particles floating near the coating target are prevented from being raised up by an accompanied flow of the shaping air, thereby consequently making it possible to epochally improve coating efficiency.

The controller may control the voltage output from the generator so that a value of a current discharged from the open end becomes constant. Hereby, even if a distance between the rotary head and the coating target changes due to changes of a shape of the coating target, for example, the voltage changes along with that, so fluctuations in the intensity of the electric field are restrained. As a result, variations in the particle diameter of the paint are restrained, so that the atomization of the paint can be stabilized and the coating efficiency can be stabilized.

An outer peripheral surface of the at least one rotary head may have a circular column shape. Hereby, even if the rotary head rotates at a high speed, it is possible to restrain air turbulence from occurring around the rotary head.

The electrostatic atomizing coating apparatus may further comprise an outer ring configured to surround the outer peripheral surface of the at least one rotary head, wherein the voltage output from the generator may be provided to the outer ring. Accordingly, a density of an electric flux line increases and the intensity of the electric field increases, thereby making it possible to promote the atomization of the paint and to carry the paint thus electrostatically atomized to the coating target on an ion wind generated by a glow discharge. Consequently, it is possible to improve the coating efficiency.

The outer ring may comprise a base portion and a front end. A sectional area of the outer ring perpendicular to an axial direction of the outer ring may decrease from the base portion of the outer ring toward the front end. A thickness of the front end may be in the range of 0.3 mm to 1 mm. A plurality of grooves may be formed on an outer peripheral surface of the front end along the axial direction of the outer ring. The outer ring may further comprise a plurality of protruding portions projecting from the front end along the axial direction of the outer ring. This further increases the intensity of the electric field, so that the atomization of the paint can be further promoted.

The apparatus may further comprise a plurality of rotary heads, and the plurality of rotary heads may be provided in parallel with each other.

An outside diameter of the at least one rotary head may be in the range of 20 mm to 50 mm.

A number of the plurality of grooves may be in the range of 600 to 1,000.

The particle diameter of the electrostatically atomized thread-shaped paint may be in the range of 20 μm to 30 μm in terms of Sauter Mean Diameter.

The motor may rotate the at least one rotary head at a speed in the range of 500 mm/s to 1,200 mm/s.

In another embodiment, there is provided an electrostatic atomizing coating method comprising discharging a thread-shaped paint from an open end of a rotary head by rotating the rotary head, the rotary head having a base portion and a plurality of grooves formed radially on an inner peripheral surface of the open end, an inside diameter of the rotary head increasing from the base portion toward the open end, electrostatically atomizing the thread-shaped paint discharged from the open end by forming an electrostatic field between the open end and a coating target, and adjusting an intensity of the electrostatic field to control a particle diameter of the electrostatically atomized thread-shaped paint. This makes it possible to atomize the paint to a particle suitable for the application without using shaping air. Hereby, paint particles attached to the coating target and paint particles floating near the coating target are prevented from being raised up by an accompanied flow of the shaping air, thereby consequently making it possible to improve coating efficiency.

The disclosed embodiments provide an electrostatic atomizing coating apparatus and a coating method thereof each of which is able to apply a paint to a coating target with efficiency by atomizing the paint without using shaping air.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

The following describes concrete embodiments with reference to the drawings. These embodiments are exemplary, but the disclosure should not be interpreted to be limited to only these embodiments. Further, the following description and drawings are simplified appropriately for clarification of the description.

Embodiment 1

Figure 1:
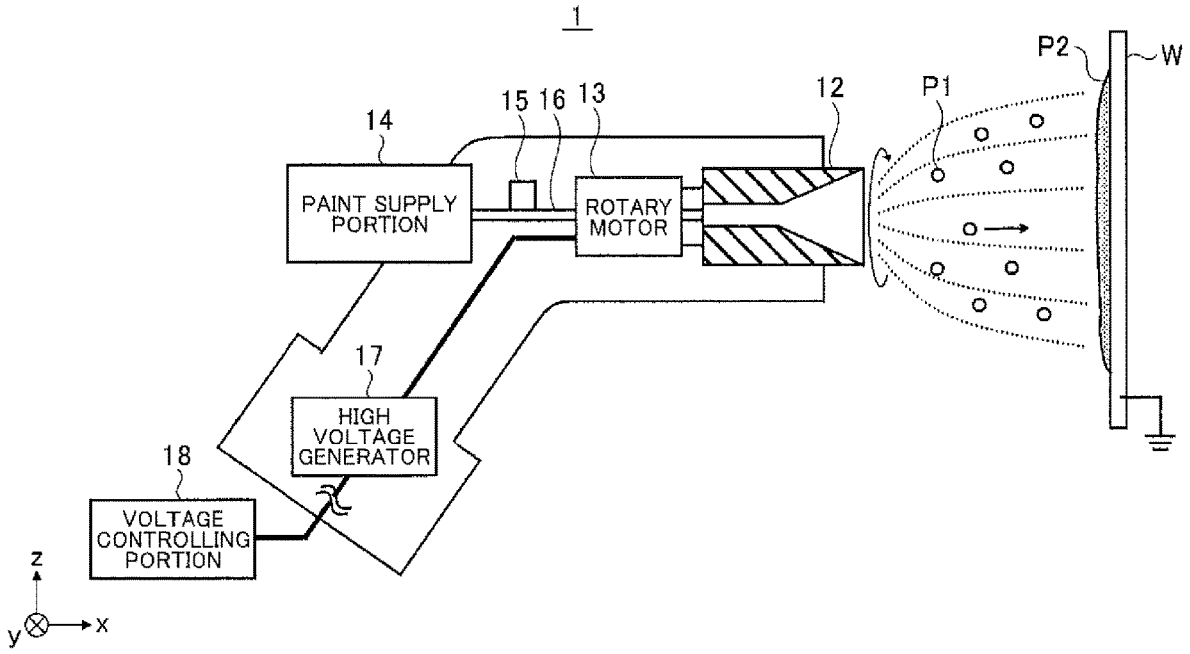
FIG. 1 is a sectional view schematically illustrating an electrostatic atomizing coating apparatus according to Embodiment 1.

First described is an electrostatic atomizing coating apparatus 1 according to Embodiment 1 with reference to FIG. 1. FIG. 1 is a sectional view schematically illustrating the electrostatic atomizing coating apparatus 1 according to Embodiment 1. Note that an xyz right handed coordinate system is illustrated in FIG. 1 for convenience of description of a positional relationship among constituents.

As illustrated in FIG. 1, the electrostatic atomizing coating apparatus 1 is a coating apparatus of an electrostatic atomizing system, and includes a rotary head 12, a rotary motor (a driving portion) 13, a paint supply portion 14, a trigger valve 15, a paint feed tube 16, a high voltage generator (a voltage providing portion) 17, and a voltage controlling portion 18.

The paint supply portion 14 stores therein a water-based paint P1 used for electrostatic atomizing coating. For example, the paint P1 is a resin paint containing water content. Note that this embodiment deals with an example in which the paint P1 is a water-based paint, but is not limited to this. The paint P1 may be, for example, an oil-based paint (a solvent paint).

The paint supply portion 14 is connected to the rotary head 12 via the paint feed tube 16. Further, the trigger valve 15 is attached to the paint feed tube 16. For example, when the trigger valve 15 is opened, the paint P1 stored in the paint supply portion 14 is supplied to the rotary head 12 via the paint feed tube 16. When the trigger valve 15 is closed, the supply of the paint P1 to the rotary head 12 from the paint supply portion 14 stops.

The rotary head 12 rotates at a high speed so as to give a centrifugal force to the paint P1, so that the paint P1 to which the centrifugal force is given is discharged in a thread shape from a plurality of grooves 12*a*. For example, a rotation number of the rotary head 12 is 10 to 50 krmp.

Figure 2:
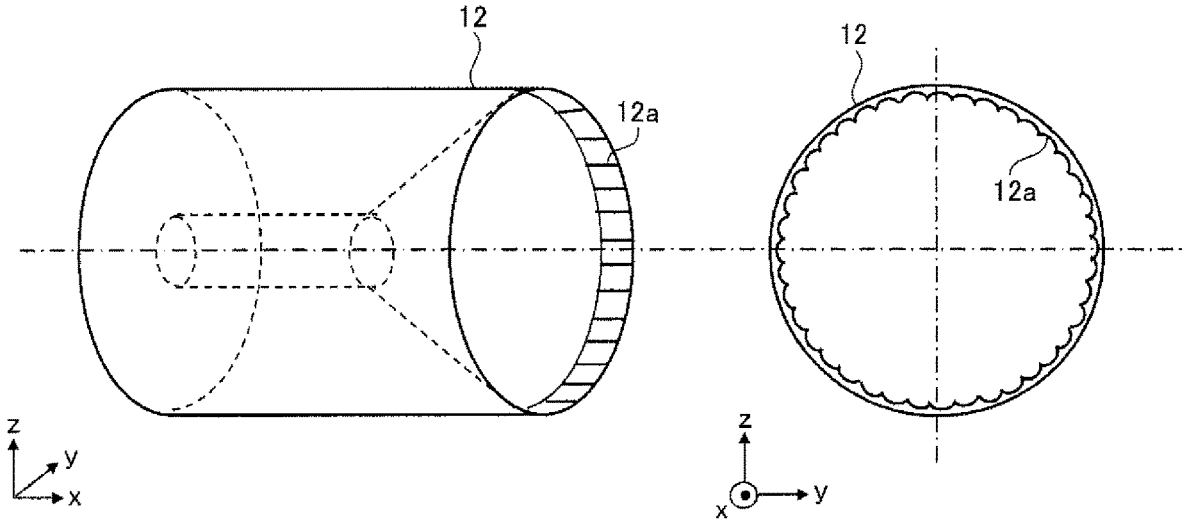
FIG. 2 is a perspective view and a side view illustrating a rotary head illustrated in FIG. 1.

FIG. 2 is a perspective view and a side view illustrating the rotary head 12. Note that an xyz coordinate in FIG. 2 is the same coordinate as in FIG. 1. With reference to FIG. 2, the rotary head 12 is formed such that an inside diameter thereof is increased from a base portion toward an open end, and the plurality of grooves 12*a* is formed radially on an inner peripheral surface of the open end. When the rotary head 12 is rotated at a high speed by use of the rotary motor 13, the paint P1 supplied to the rotary head 12 from the paint supply portion 14 is affected by the centrifugal force, so that the paint P1 reaches the open end along the inner peripheral surface, and then discharged in a thread shape in a centrifugal direction from the plurality of grooves 12*a* formed on the inner peripheral surface of the open end.

For example, an outside diameter of the rotary head 12 is around 20 to 50 mm, and the number of grooves 12*a* is around 600 to 1000.

Further, the rotary head 12 is made of a conductive material. More specifically, the rotary head 12 is made of a metallic material with high strength and low resistance, such as, for example, aluminum, titanium, and stainless steel. Hereby, the rotary head 12 can be used as an electrode for forming an electrostatic field between the rotary head 12 and an earthed workpiece (a coating target) W (to be described later).

Note that it is preferable that an outer peripheral surface of the rotary head 12 have a circular column shape. Hereby, even if the rotary head 12 rotates at a high speed, it is possible to restrain air turbulence from occurring around the rotary head 12.

The high voltage generator 17 generates a negative high voltage and applies it to the rotary head 12, so that the rotary head 12 is charged with negative charge. Hereby, a strong electrostatic field is formed between the rotary head 12 as a negative electrode and the workpiece W as a positive electrode.

The thread-shaped paint P1 discharged from the rotary head 12 is split into droplets and atomized by an electrostatic force of the electrostatic field formed between the rotary head 12 and the workpiece W. That is, the thread-shaped paint P1 is electrostatically atomized. As illustrated in FIG. 1, the paint P1 thus electrostatically atomized is drawn to the earthed workpiece W due to negative charges of the paint P1 itself, and then applied to the workpiece W. Hereby, a coating film P2 is formed on the workpiece W.

Here, the paint P1 is electrostatically atomized by the electrostatic force in the electrostatic field formed between the rotary head 12 and the workpiece W without using shaping air. Hereby, paint particles attached to the workpiece W and paint particles floating near the workpiece W are not raised up by an accompanied flow of the shaping air, thereby making it possible to improve coating efficiency.

Further, an ion wind is generated from a front end of the rotary head 12 by a glow discharge, so that stable fly and pattern formation of the atomized paint P1 can be assisted.

The voltage controlling portion 18 controls an output voltage of the high voltage generator 17 to adjust an intensity of the electrostatic field, so that a particle diameter of the paint P1 to be electrostatically atomized is controlled to a particle diameter suitable for the application and variations in the particle diameter of the paint P1 to be electrostatically atomized are restrained.

For example, in a case where the output voltage of the high voltage generator 17 is increased by the voltage controlling portion 18 so as to increase the intensity of the electrostatic field, the electrostatic force increases, so that the particle diameter of the paint P1 to be electrostatically atomized is decreased. In the meantime, in a case where the output voltage of the high voltage generator 17 is decreased by the voltage controlling portion 18 so as to decrease the intensity of the electrostatic field, the electrostatic force decreases, so that the particle diameter of the paint P1 to be electrostatically atomized is increased. Note that the particle diameter suitable for the application is preferably 20 to 30 μm in terms of SMD (Sauter Mean Diameter), for example.

Note that a coating pattern can be controlled by adjusting the intensity of the electrostatic field by the voltage controlling portion 18. For example, when the intensity of the electrostatic field is increased by the voltage controlling portion 18, straightness of the electrostatically atomized paint P1 increases, so that the coating pattern becomes narrow. In the meantime, when the intensity of the electrostatic field is decreased by the voltage controlling portion 18, straightness of the electrostatically atomized paint P1 decreases, so that the coating pattern becomes wide.

Figure 3:
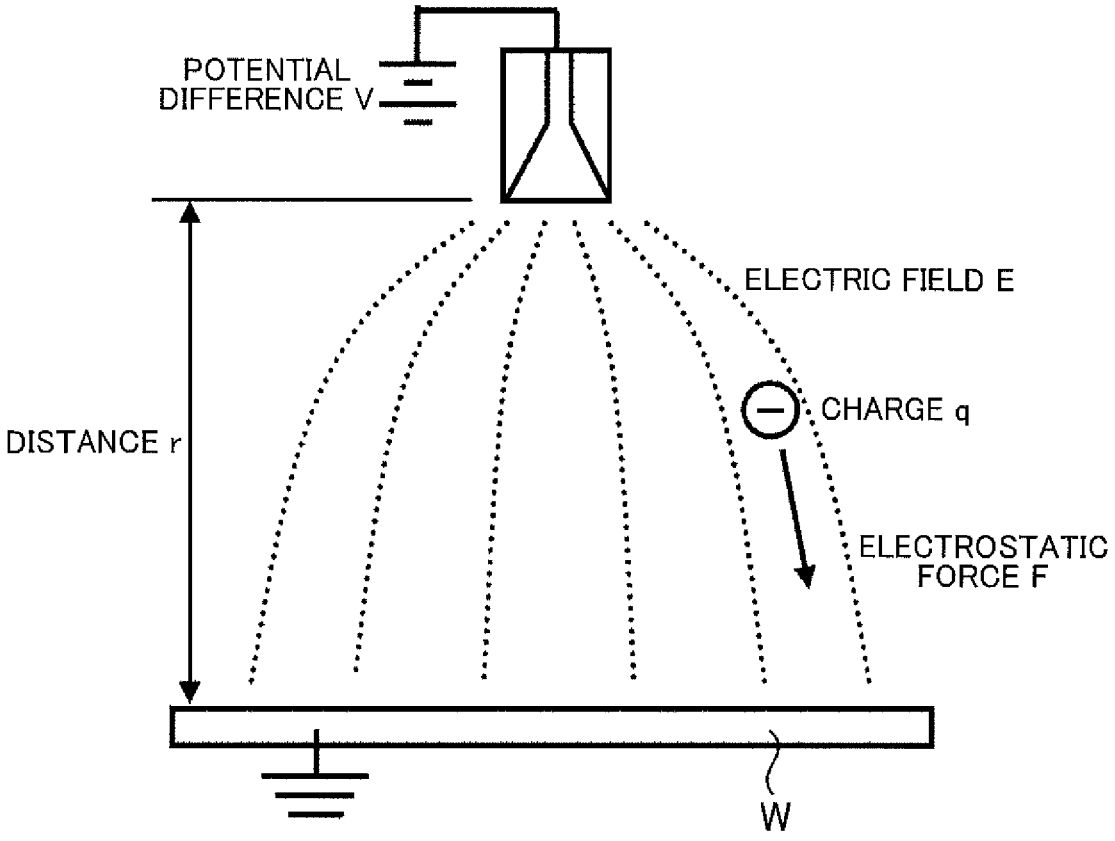
FIG. 3 is a schematic view to describe an electrostatic field formed between the rotary head illustrated in FIG. 1 and a workpiece W and an electrostatic force of the electrostatic field.

FIG. 3 is a schematic view to describe the electrostatic field formed between the rotary head 12 and the workpiece W and an electrostatic force of the electrostatic field. With reference to FIG. 3, when an electric field intensity between the rotary head 12 and the workpiece W is indicated by E, a potential difference therebetween is indicated by V, and a distance therebetween is indicated by r, $E=V/r$ is established.

If the voltage controlling portion 18 is configured to control the output voltage of the high voltage generator 17 so that a potential of the open end of the rotary head 12 is always constant, the potential difference V is fixed, so that the electric field intensity E changes according to changes in the distance r. As a result, the particle diameter of the paint P1 to be electrostatically atomized varies, thereby resulting in that electrostatic atomization of the paint P1 becomes unstable and the coating efficiency becomes unstable.

In view of this, the voltage controlling portion 18 controls the output voltage of the high voltage generator 17 so that a current (discharge current) discharged from the open end of the rotary head 12 is always constant. Accordingly, the potential difference V changes according to changes of the distance r, so that fluctuations in the electric field intensity E are restrained. More specifically, when the distance r becomes long, a resistance component R to a discharge current I increases, so that the potential difference V ($=R\times I$) increases. When the distance r becomes short, the resistance component R to the discharge current I decreases, so that the potential difference V ($=R\times I$) decreases. Accordingly, the fluctuations in the electric field intensity E are restrained. As a result, the variations in the particle diameter of the paint P1 to be electrostatically atomized are restrained, so that the electrostatic atomization of the paint P1 can be stabilized and the coating efficiency can be stabilized.

Figure 4:
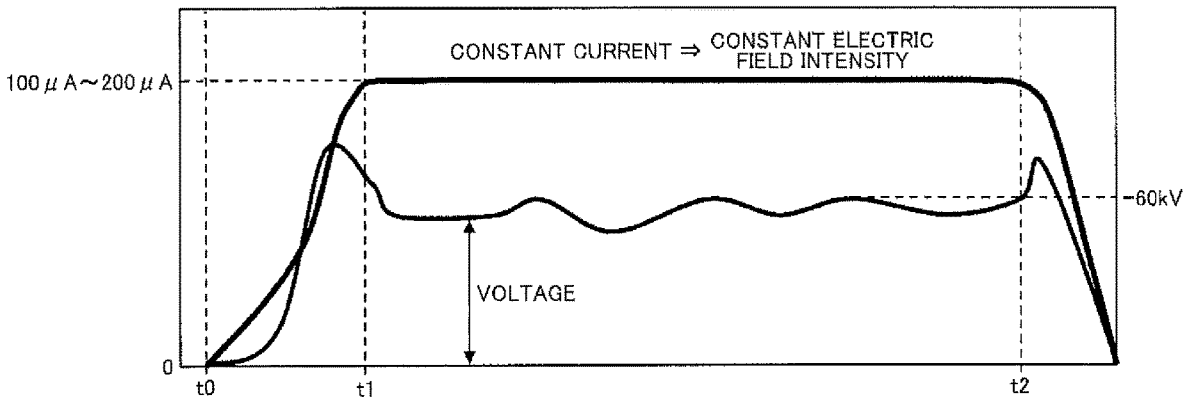
FIG. 4 is a timing chart illustrating changes of a current value and a voltage value of the rotary head at the time when a constant current control is performed.

FIG. 4 is a timing chart illustrating changes of a current value and a voltage value of the rotary head 12 (the open end thereof) at the time when a constant current control is performed. With reference to FIG. 4, when a high voltage is applied to the rotary head 12 (time t0), the current value of the rotary head 12 is maintained at a constant value (100 to 200 μA in the example of FIG. 4) (times t1 to t2) until the application of the high voltage is stopped (time t2). While the current value is maintained at the constant value, even if the distance r changes due to a change or the like of a shape of the coating target, the voltage value (around −60 kV in the example of FIG. 4) changes according to the change of the distance r, so that the fluctuations in the electric field intensity E are restrained. As a result, the variations in the particle diameter of the paint P1 to be electrostatically atomized are restrained, so that the electrostatic atomization of the paint P1 can be stabilized and the coating efficiency can be stabilized.

Figure 5:
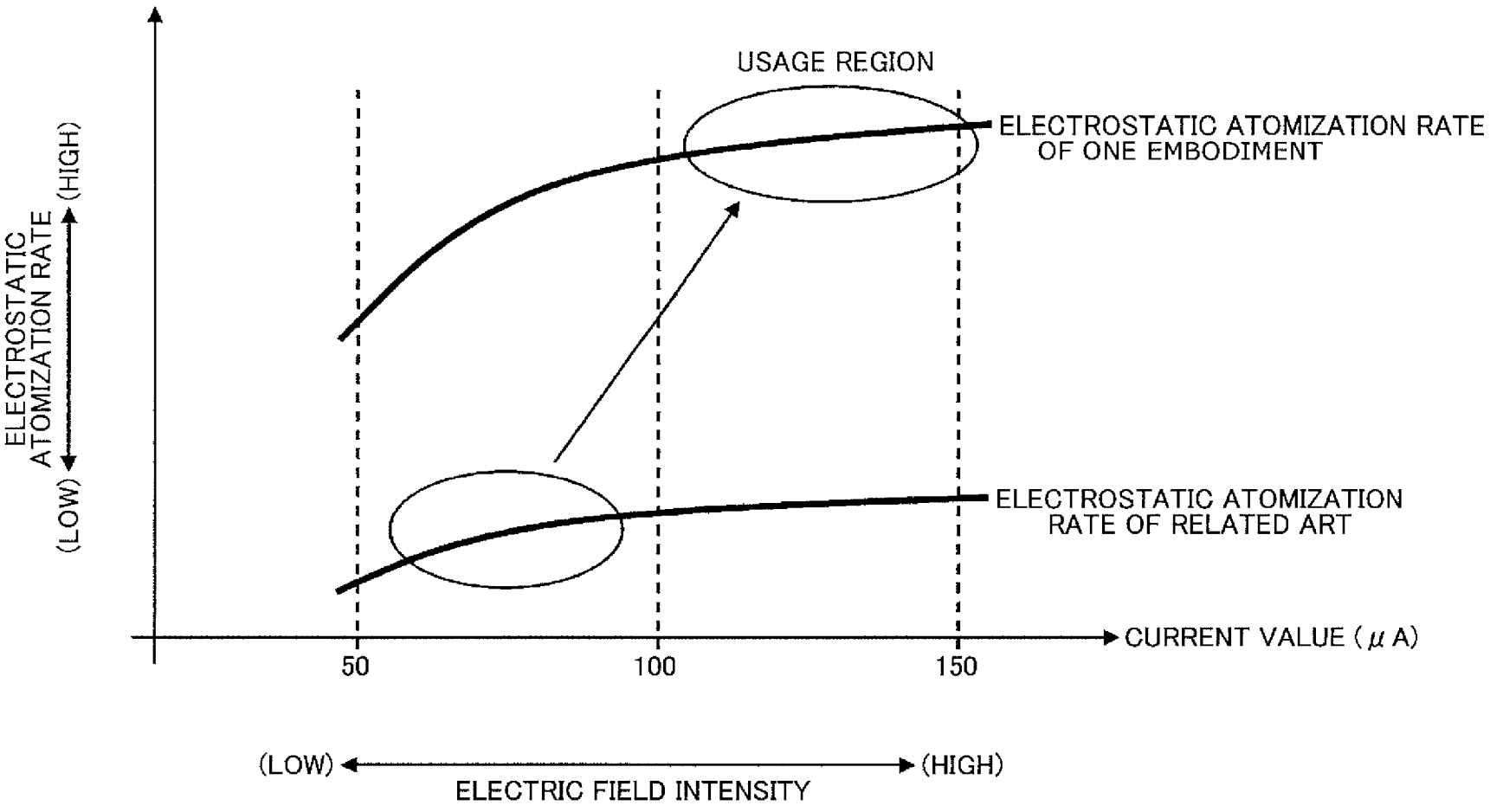
FIG. 5 is a view in which a coating method according to an embodiment in which atomization of a paint by static electricity is used is compared, in terms of a difference in electric field intensity, with a coating method of the related art in which atomization of a paint by static electricity is not used.

FIG. 5 is a view in which a coating method according to an embodiment in which atomization of a paint is performed mainly by use of static electricity without using shaping air is compared, in terms of a difference in electric field intensity, with a coating method of the related art in which atomization of a paint is performed mainly by use of shaping air without using static electricity. With reference to FIG. 5, in the coating method of the related art in which the atomization of a paint by static electricity is not mainly performed, a current value of the rotary head 12 is 100 μA or less, which is low, so the electric field intensity is low. In contrast, in the coating method according to an embodiment in which the atomization of a paint by static electricity is mainly performed, a current value of the rotary head 12 is 100 to 200 μA, which is high, so the electric field intensity is high.

Figure 6:
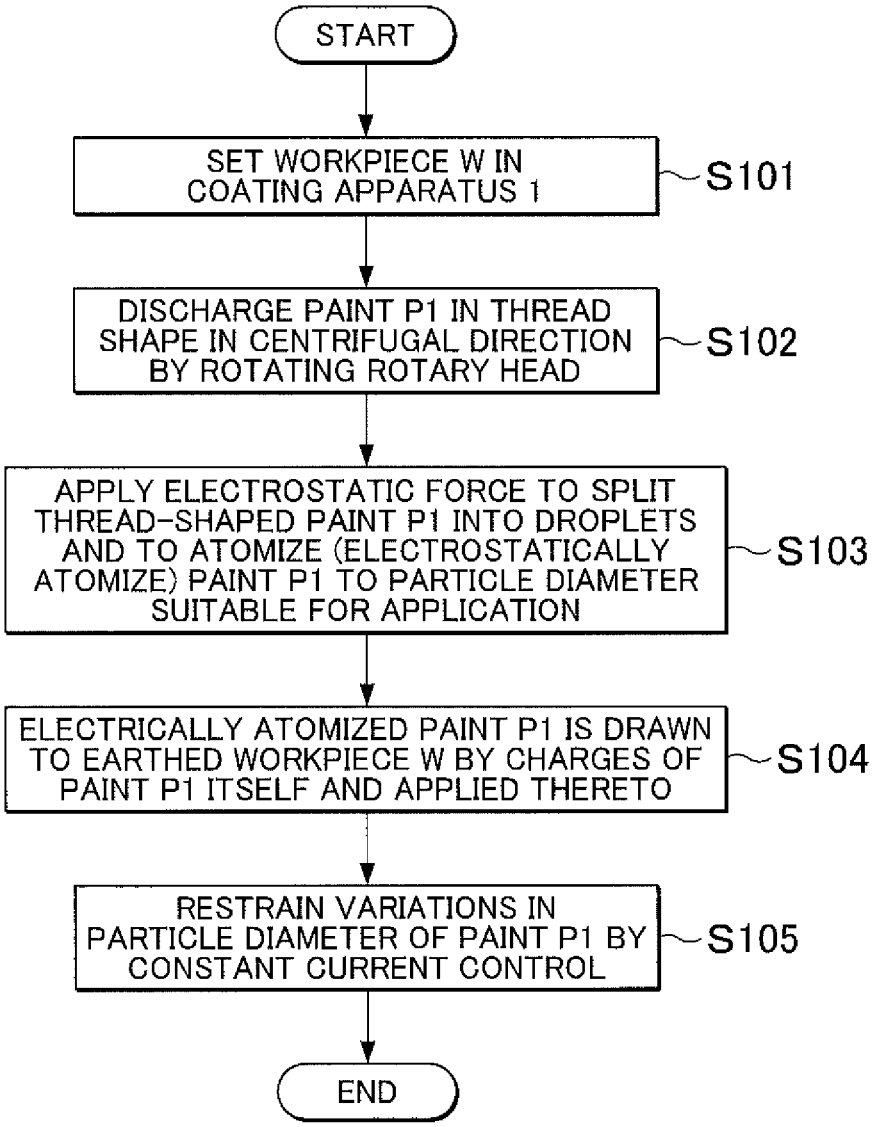
FIG. 6 is a flowchart illustrating a coating method of the electrostatic atomizing coating apparatus illustrated in FIG. 1.

Subsequently, a coating method according to the electrostatic atomizing coating apparatus 1 is described. FIG. 6 is a flowchart illustrating the coating method of the electrostatic atomizing coating apparatus 1, First, an earthed workpiece (a coating target) W is set in the electrostatic atomizing coating apparatus 1 (step S101). For example, the workpiece W is a body or the like of a vehicle.

After that, the electrostatic atomizing coating apparatus 1 is started. More specifically, the rotary head 12 is rotated at a high speed, and an electrostatic field is formed between the rotary head 12 and the workpiece W by applying a negative high voltage to the rotary head 12. Note that, naturally, the electrostatic atomizing coating apparatus 1 may be started before the workpiece W is set.

After that, the trigger valve 15 is opened so as to supply the paint P1 stored in the paint supply portion 14 to the rotary head 12 that rotates at a high speed. The paint P1 thus supplied to the rotary head 12 is affected by a centrifugal force, so that the paint P1 is discharged in a thread shape in a centrifugal direction from the plurality of grooves 12*a* formed on the inner peripheral surface of the open end of the rotary head 12 (step S102).

After that, the thread-shaped paint P1 discharged from the rotary head 12 is split into droplets and atomized to a particle diameter suitable for the application, by an electrostatic force of the electrostatic field formed between the rotary head 12 and the workpiece W. That is, the thread-shaped paint P1 is electrostatically atomized (step S103).

The paint P1 thus electrostatically atomized by the electrostatic force of the electrostatic field formed between the rotary head 12 and the workpiece W is drawn to the earthed workpiece W by negative charges of the paint P1 itself, and then applied to the rotary head 12 (step S104). Hereby, a coating film P2 is formed on the workpiece W. Further, the paint P1 thus electrostatically atomized is carried on an ion wind to the workpiece W. The ion wind is generated by a glow discharge of the rotary head 12. Hereby, the coating to the workpiece W is promoted.

Here, when the rotary head 12 is moved to move a target area for the coating, the distance r between the rotary head 12 and the workpiece W changes depending on a shape of the workpiece W. Accordingly, if the potential of the open end of the rotary head 12 is fixed, the electric field intensity E (=V/r) fluctuates according to changes in the distance r. In view of this, in this embodiment, the output voltage of the high voltage generator 17 is controlled so that a current discharged from the open end of the rotary head 12 is always constant (step S105). Accordingly, the potential difference V changes according to the changes of the distance r, so that the fluctuations in the electric field intensity E are restrained. As a result, the variations in the particle diameter of the paint P1 to be electrostatically atomized are restrained, so that the electrostatic atomization of the paint P1 can be stabilized and the coating efficiency can be stabilized.

Note that, in the coating method according to this embodiment, the distance r is made as short as possible. This accordingly increases the electric field intensity E (=V/r), so that the atomization of the paint P1 can be promoted.

Figure 7:
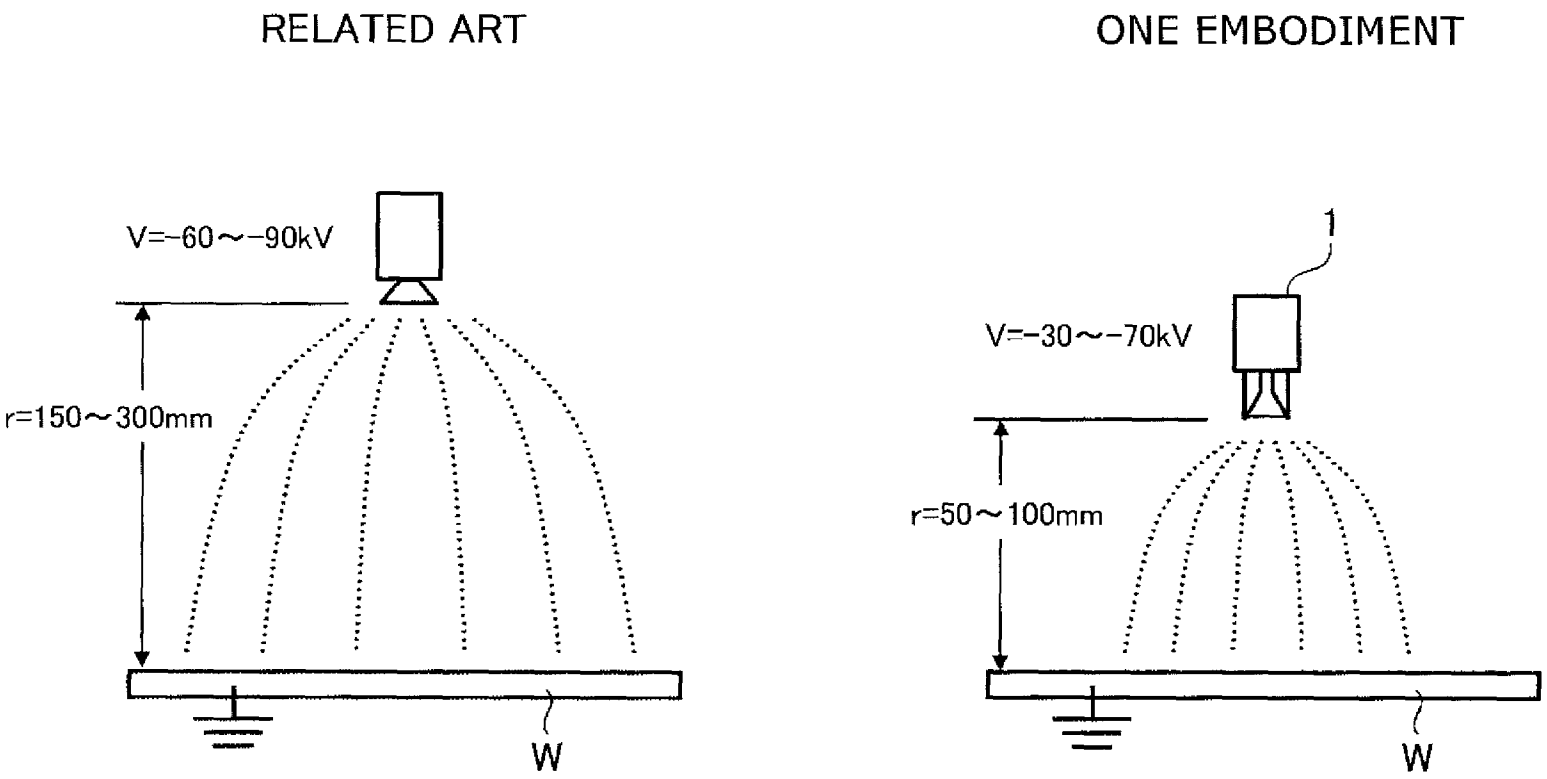
FIG. 7 is a view in which the coating method according to an embodiment in which atomization of a paint by static electricity is used is compared, in terms of a distance between the rotary head and the workpiece W, with the coating method of the related art in which atomization of a paint by static electricity is not used.

FIG. 7 is a view in which the coating method according to an embodiment in which atomization of a paint is performed by use of static electricity without using shaping air is compared, in terms of the distance r between the rotary head 12 and the workpiece W, with the coating method of the related art in which atomization of a paint is performed by use of shaping air without using static electricity.

With reference to FIG. 7, the distance r is 150 to 300 mm (the voltage V of −60 to −90 kV) in the coating method of the related art, whereas the distance r is shortened to around 50 to 100 mm (the voltage V of −30 to −70 kV) in the coating method of this embodiment. Hereby, in the coating method of this embodiment, the electric field intensity E increases, so that the electrostatic atomization of the paint P1 can be promoted.

Further, in the coating method according to this embodiment, a sectional area of the front end (the open end) of the rotary head 12 is made as small as possible. Here, when a vacuum permittivity is indicated by $\varepsilon_0$, $E=q/4\pi\varepsilon_0 r^2$ is established according to the Gauss' theorem. That is, the electric field intensity E is proportional to a density of an electric flux line. Accordingly, when the sectional area of the front end (the open end) of the rotary head 12 is decreased to increase the density of the electric flux line, the electric field intensity E increases, thereby making it possible to promote the electrostatic atomization of the paint P1.

Further, in the coating method according to this embodiment, a moving speed of the rotary head 12 is slower than that in the coating method of the related art.

Figure 8:
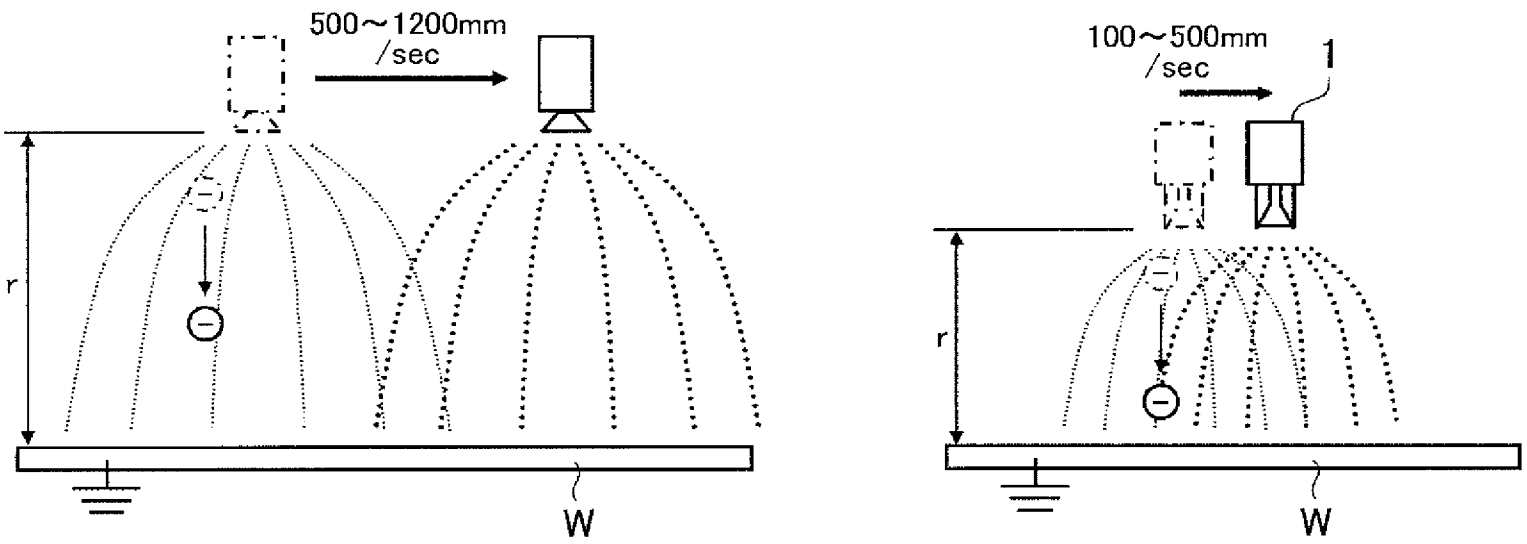
FIG. 8 is a view in which the coating method according to an embodiment in which atomization of a paint by static electricity is used is compared, in terms of a moving speed of the rotary head, with the coating method of the related art in which atomization of a paint by static electricity is not used.

FIG. 8 is a view in which the coating method according to an embodiment in which atomization of a paint is performed by use of static electricity without using shaping air is compared, in terms of the moving speed of the rotary head 12, with the coating method of the related art in which atomization of a paint is performed by use of shaping air without using static electricity.

With reference to FIG. 8, the moving speed is 500 to 1200 mm/sec in the coating method of the related art, whereas the moving speed is decreased to about 100 to 500 mm/sec in the coating method of this embodiment. The atomized paint P1 deviates from the electric field and loses its straightness in the coating method of the related art, whereas the atomized paint P1 stays in the electric field until the atomized paint P1 is applied in the coating method of this embodiment, which realizes a high application property. Hereby, in the coating method of this embodiment, it is possible to prevent the atomized paint P1 from deviating from the electric field and losing the straightness, thereby making it possible to prevent a decrease of the coating efficiency.

Figure 9:
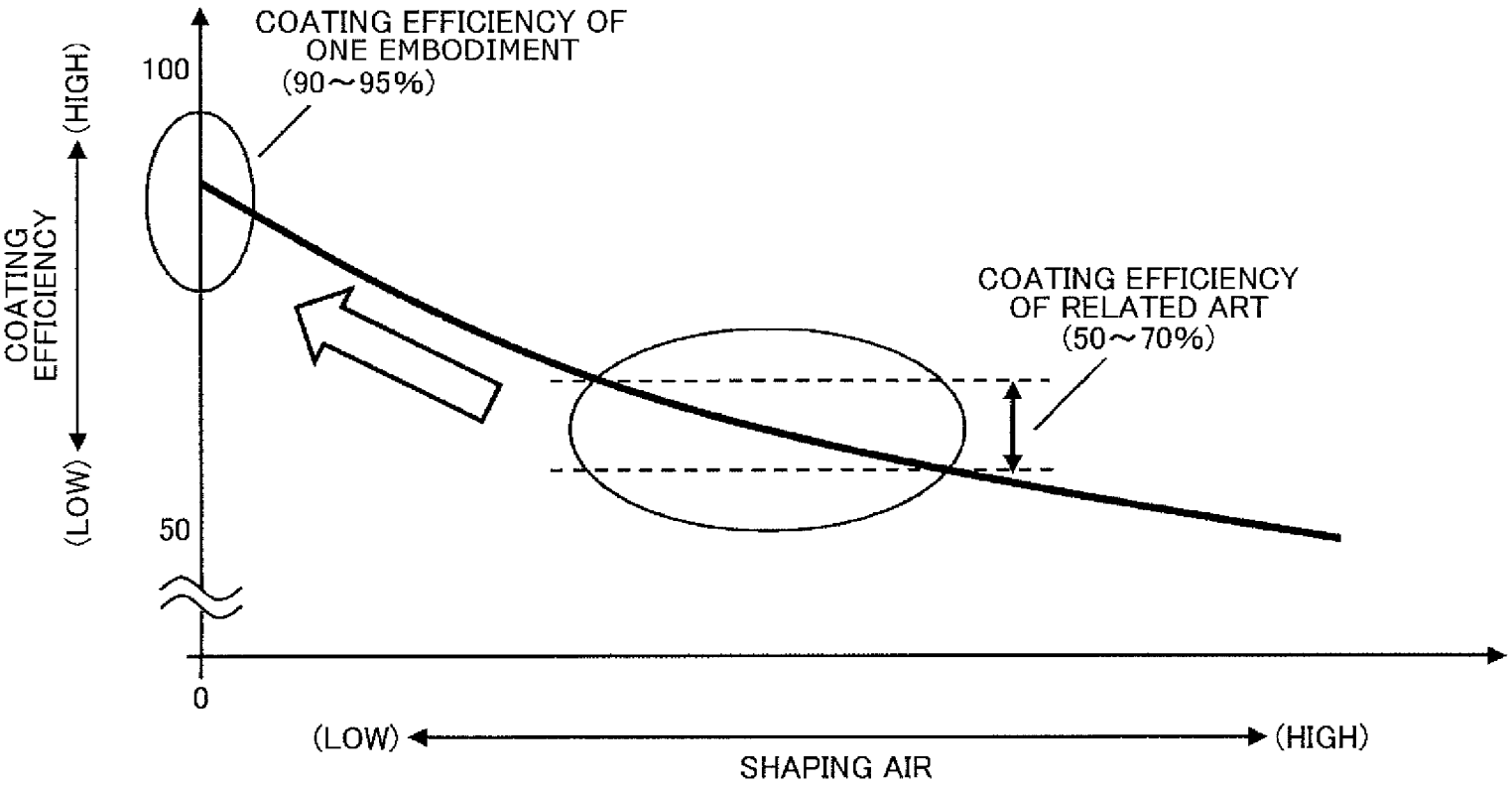
FIG. 9 is a view illustrating a relationship between an airflow rate of shaping air and coating efficiency.

FIG. 9 is a view illustrating a relationship between an airflow rate of shaping air and coating efficiency. With reference to FIG. 9, in the coating method of the related art using the shaping air, the paint P1 attached to the workpiece W and the paint P1 floating near the workpiece W are raised up by an accompanied flow of the shaping air, so the coating efficiency is low (50 to 70% in this example). In contrast, in the coating method of an embodiment that does not use shaping air, the paint P1 attached to the workpiece W and the paint P1 floating near the workpiece W are not raised up by the accompanied flow of the shaping air, so the coating efficiency is high (90 to 95% in this example).

Figure 10:
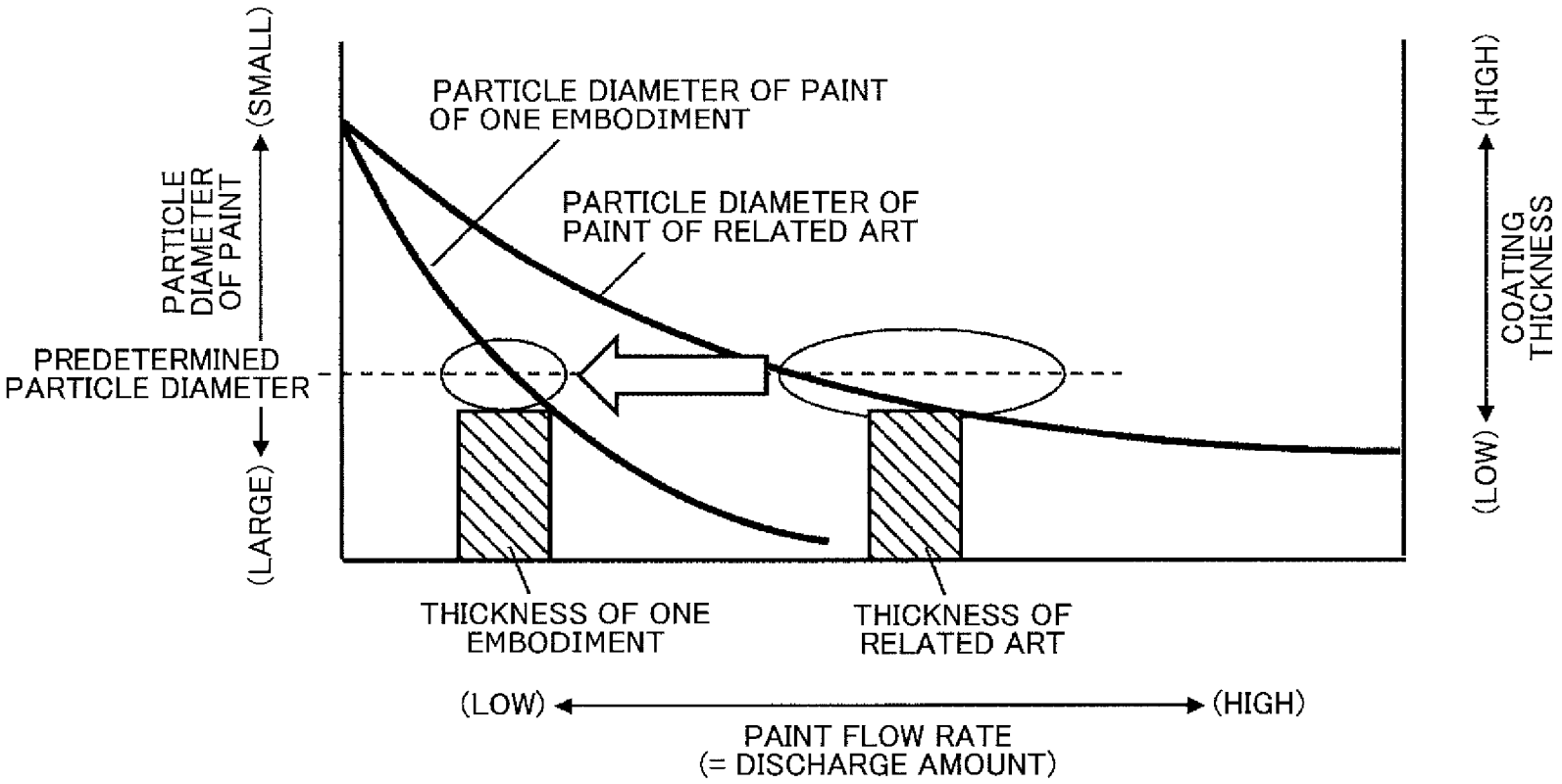
FIG. 10 is a view illustrating a relationship among a paint flow rate (discharge amount), a paint particle diameter, and a coating thickness.

FIG. 10 is a view illustrating a relationship among a paint flow rate (discharge amount), a paint particle diameter, and a coating thickness. With reference to FIG. 10, in a case where a paint P1 with a predetermined particle diameter is to be generated, a paint flow rate per unit time decreases in the coating method an embodiment that does not use shaping air, as compared with the coating method of the related art that uses shaping air. However, in the coating method of this embodiment, the paint P1 attached to the workpiece W and the paint P1 floating near the workpiece W are not raised up by the accompanied flow of the shaping air, so a coating film P2 with a thickness at the same level as the related art can be formed even at a small paint flow rate. That is the coating efficiency can be improved without largely losing productivity (machining ability).

As such, the electrostatic atomizing coating apparatus 1 electrostatically atomizes the paint P1 by the electrostatic force in the electrostatic field formed between the rotary head 12 and the workpiece W without using shaping air. Hereby, paint particles attached to the workpiece W and paint particles floating near the workpiece W are not raised up by the accompanied flow of the shaping air, thereby making it possible to improve the coating efficiency.

Further, the electrostatic atomizing coating apparatus 1 controls the output voltage of the high voltage generator 17 so that the current discharged from the open end of the rotary head 12 is always constant. Accordingly, the potential difference V changes according to changes of the distance r, so that fluctuations in the electric field intensity E are restrained. As a result, variations in the particle diameter of the paint P1 to be electrostatically atomized are restrained, so that the atomization of the paint P1 can be stabilized and the coating efficiency can be stabilized.

Embodiment 2

Figure 11:
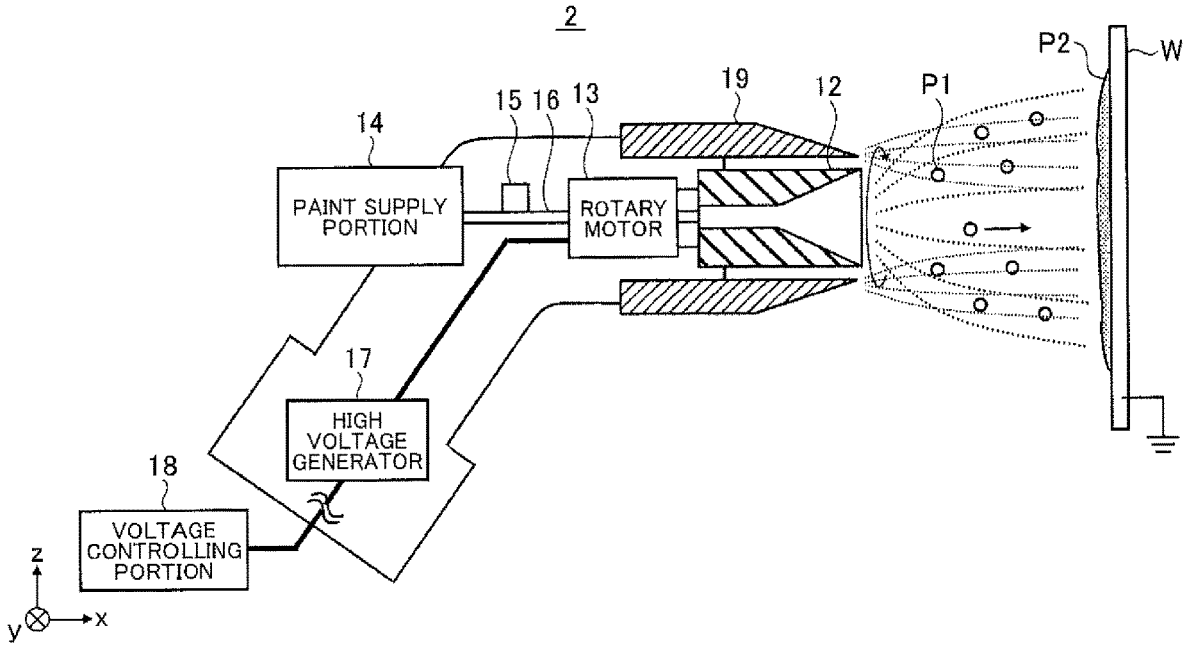
FIG. 11 is a sectional view schematically illustrating an electrostatic atomizing coating apparatus according to Embodiment 2.

FIG. 11 is a sectional view schematically illustrating an electrostatic atomizing coating apparatus 2 according to Embodiment 2. The electrostatic atomizing coating apparatus 2 further includes an outer ring 19 in comparison with the electrostatic atomizing coating apparatus 1. Note that an xyz right handed coordinate system is illustrated in FIG. 11 for convenience of description of a positional relationship among constituents.

As illustrated in FIG. 11, the outer ring 19 is used as a supporting electrode of a rotary head 12 as a negative electrode, and has a circular column shape formed so as to surround an outer peripheral surface of the rotary head 12.

Figure 12:
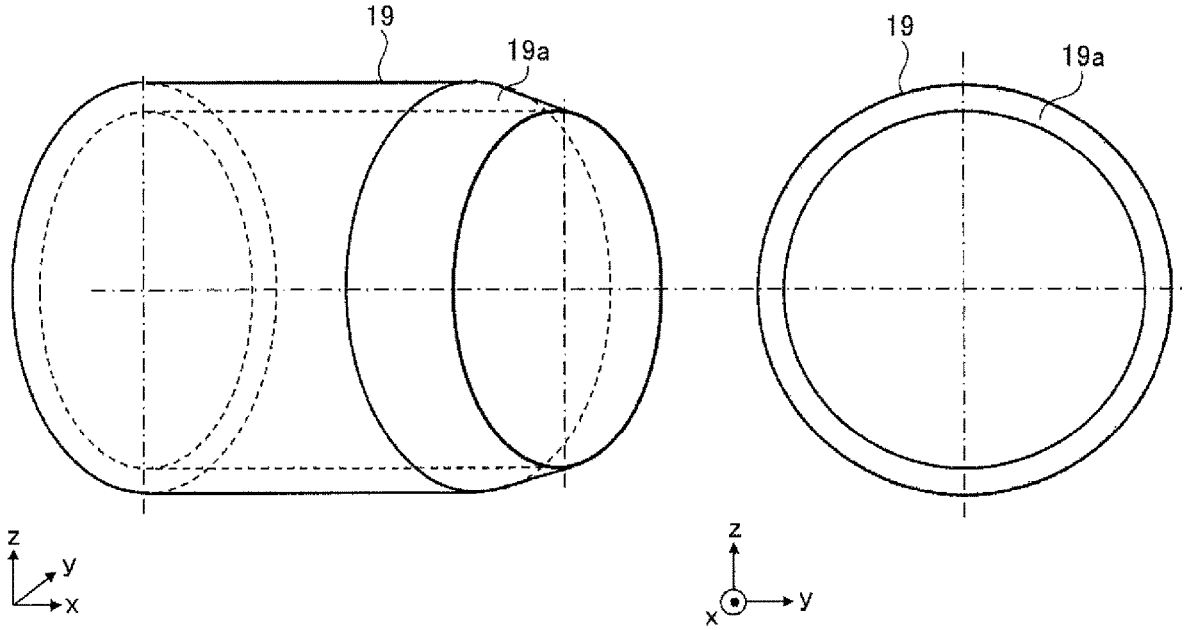
FIG. 12 is a perspective view and a side view illustrating an outer ring illustrated in FIG. 11.

FIG. 12 is a perspective view and a side view of the outer ring 19. Note that an xyz coordinate in FIG. 12 is the same coordinate as in FIG. 11. The outer ring 19 has a circular column shape formed so as to surround the outer peripheral surface of the rotary head 12 as described above. Further, the outer ring 19 includes an inclined portion 19*a* formed such that an outside diameter thereof is reduced toward a front end (an end portion positioned on an open-end side of the rotary head 12). Note that an inclination angle of the outer peripheral surface with respect to an inner peripheral surface of the inclined portion 19*a* is 0.1 rad or less, for example.

Further, the outer ring 19 is made of a conductive material. More specifically, the outer ring 19 is made of a metallic material with a low resistance, such as copper or aluminum. Hereby, the outer ring 19 can be used as a negative electrode for forming an electrostatic field with respect to an earthed workpiece W, together with the rotary head 12.

A high voltage generator 17 applies a negative high voltage to not only the rotary head 12 but also the outer ring 19, so that the rotary head 12 and the outer ring 19 are charged with negative charge. Hereby, a further strong electrostatic field is formed between the workpiece W and each of the rotary head 12 and the outer ring 19.

Here, in this embodiment, the outer ring 19 is formed such that a sectional area perpendicular to an axial direction (an x-axis direction) decreases from a base portion toward the front end. It is preferable that the sectional area of the front end be formed as small as possible. For example, a thickness of the front end of the outer ring 19 is around 0.3 to 1 mm. Hereby, a density of an electric flux line increases and an electric field intensity E increases, thereby making it possible to promote electrostatic atomization of a paint P1.

Further, stronger ion winds are generated from respective front ends of the rotary head 12 and the outer ring 19 by a glow discharge, so that stable fly and pattern formation of the atomized paint P1 can be assisted.

The other configurations of the electrostatic atomizing coating apparatus 2 are the same as those of the electrostatic atomizing coating apparatus 1, so descriptions thereof are omitted.

Figure 13:
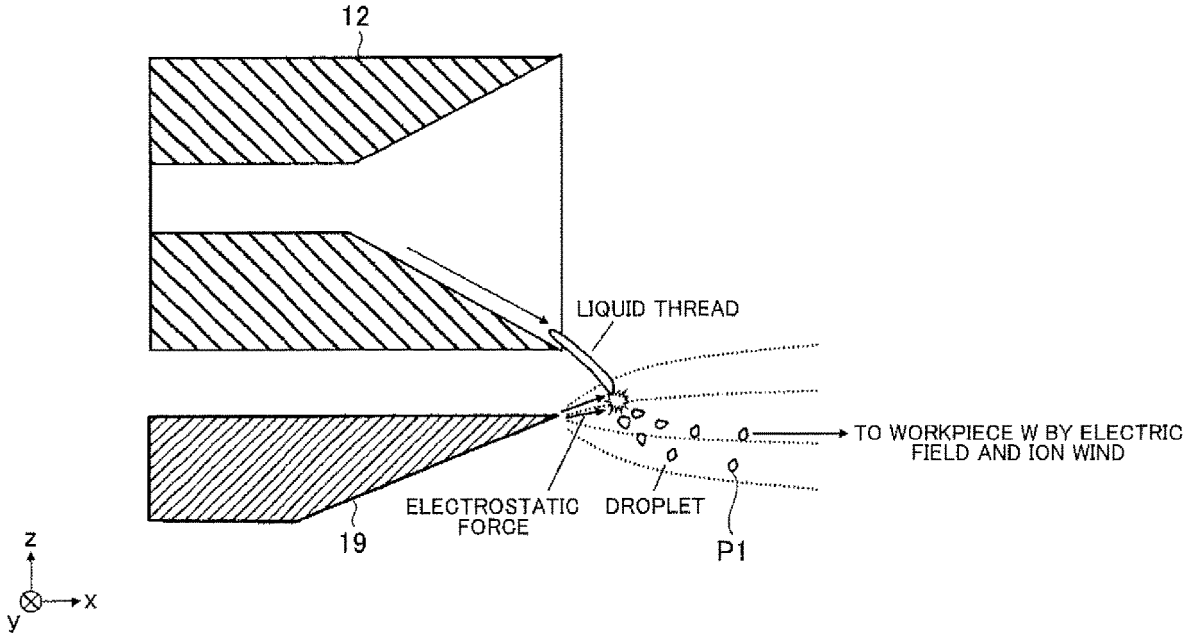
FIG. 13 is an enlarged sectional view of a peripheral region of respective front ends of a rotary head and the outer ring of the electrostatic atomizing coating apparatus illustrated in FIG. 11.
Figure 14:
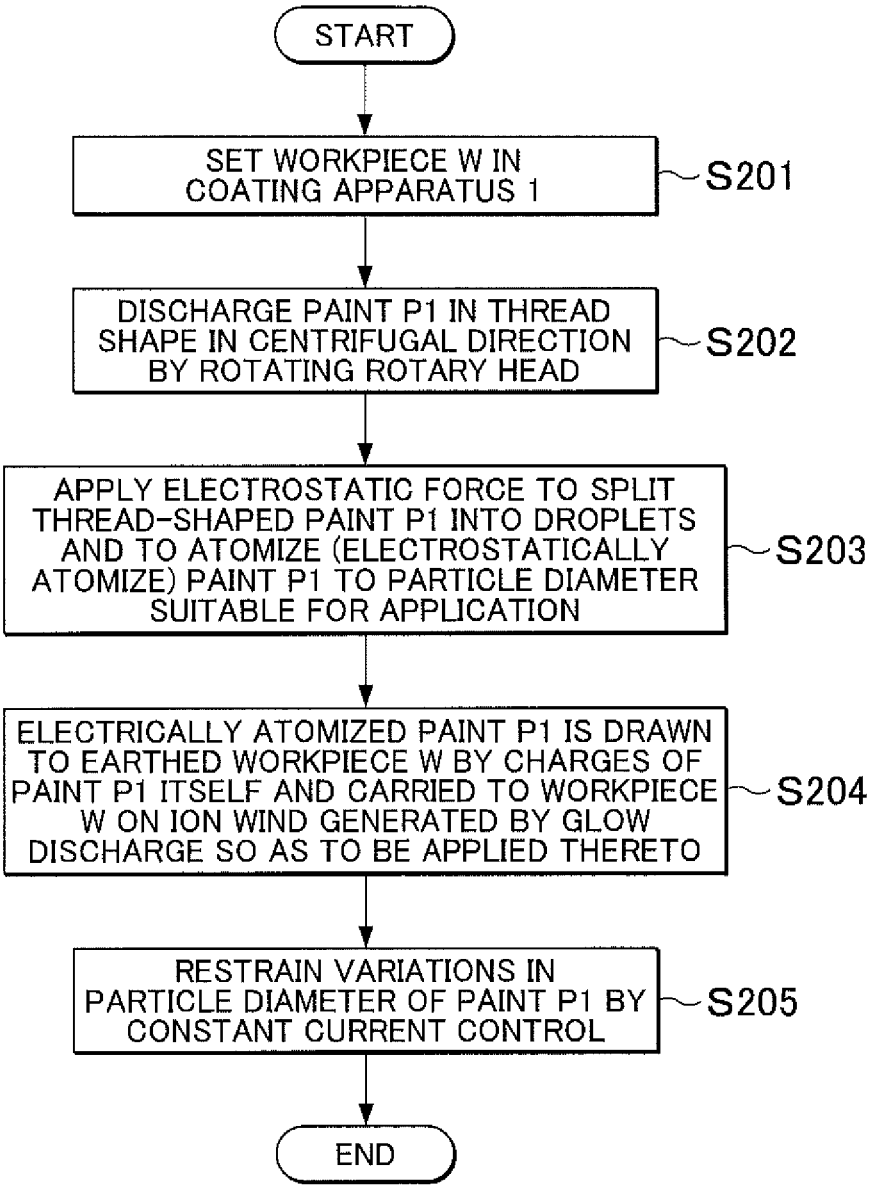
FIG. 14 is a flowchart illustrating a coating method of the electrostatic atomizing coating apparatus illustrated in FIG. 11.

Subsequently, a coating method according to the electrostatic atomizing coating apparatus 2 is described. FIG. 13 is an enlarged sectional view of a peripheral region of respective front ends of the rotary head 12 and the outer ring 19 of the electrostatic atomizing coating apparatus 2. FIG. 14 is a flowchart illustrating the coating method of the electrostatic atomizing coating apparatus 2.

Note that processes of steps S201 to S205 in FIG. 14 correspond to the processes of steps S101 to S105 in FIG. 6, respectively.

Here, in step S203, a thread-shaped paint P1 discharged from the rotary head 12 is split into droplets and atomized to a particle diameter suitable for the application, by an electrostatic force of an electrostatic field formed between the workpiece W and each of the rotary head 12 and the outer ring 19. That is, the thread-shaped paint P1 is electrostatically atomized.

Further, in step S204, the paint P1 thus electrostatically atomized is drawn to the earthed workpiece W due to negative charges of the paint P1 itself, and is carried on ion winds to the workpiece W and applied thereto. The ion winds are generated by a glow discharge of the rotary head 12 and the outer ring 19. Hereby, a coating film P2 is formed on the workpiece W.

The other processes of the electrostatic atomizing coating apparatus 2 are basically the same as those of the electrostatic atomizing coating apparatus 1, so descriptions thereof are omitted.

Figure 15:
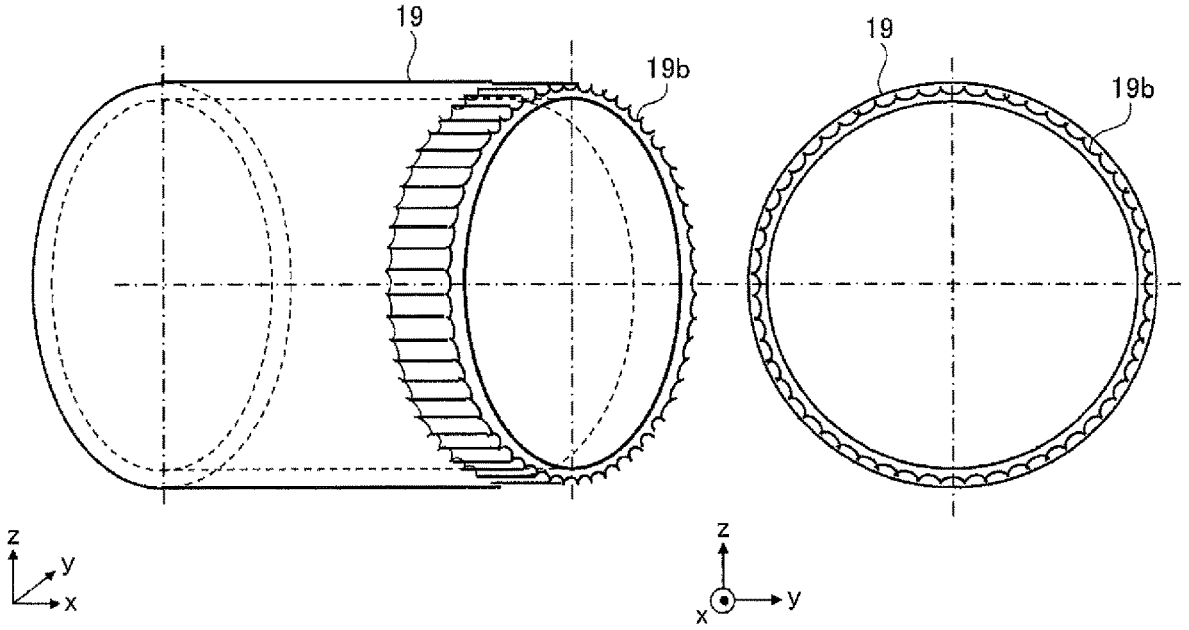
FIG. 15 is a perspective view and a side view illustrating a first modification of the outer ring illustrated in FIG. 11.

Note that, instead of the outer ring 19 illustrated in FIG. 12, an outer ring 19 illustrated in FIG. 15 may be used. The outer ring 19 illustrated in FIG. 15 has a plurality of grooves 19*b* formed on an outer peripheral surface of a front end of the outer ring 19 along an axial direction thereof, instead of the inclined portion 19*a*.

Figure 16:
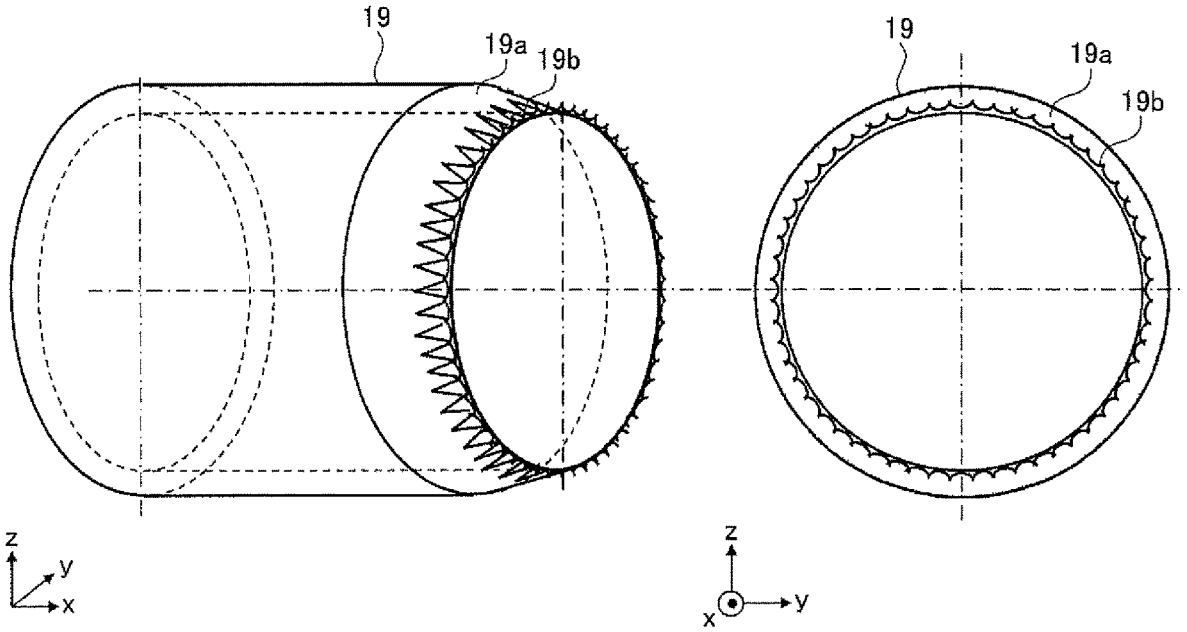
FIG. 16 is a perspective view and a side view illustrating a second modification of the outer ring illustrated in FIG. 11.

Further, instead of the outer ring 19 illustrated in FIG. 12, an outer ring 19 illustrated in FIG. 16 may be used. The outer ring 19 illustrated in FIG. 16 further has a plurality of grooves 19*b* formed on a surface of an inclined portion 19*a* (that is, an outer peripheral surface of its front end) along an axial direction of the outer ring 19.

Figure 17:
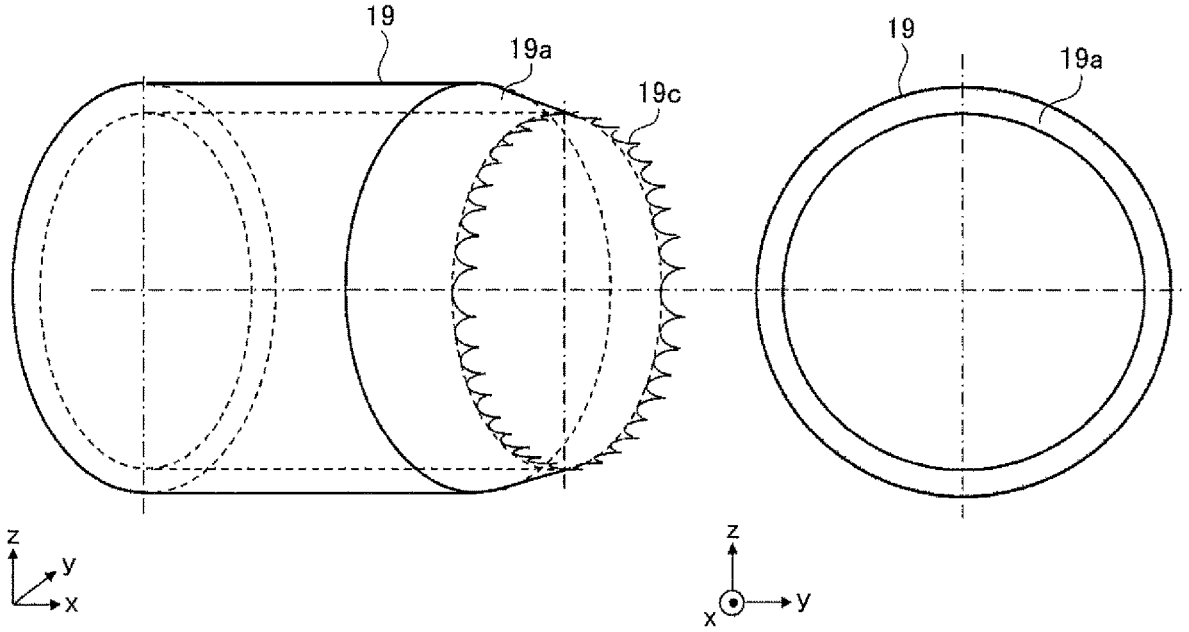
FIG. 17 is a perspective view and a side view illustrating a third modification of the outer ring illustrated in FIG. 11.

Further, instead of the outer ring 19 illustrated in FIG. 12, an outer ring 19 illustrated in FIG. 17 may be used. The outer ring 19 illustrated in FIG. 17 further has a plurality of protruding portions 19*c* projecting from a front end of the outer ring 19 along an axial direction thereof.

Embodiment 3

Figure 18:
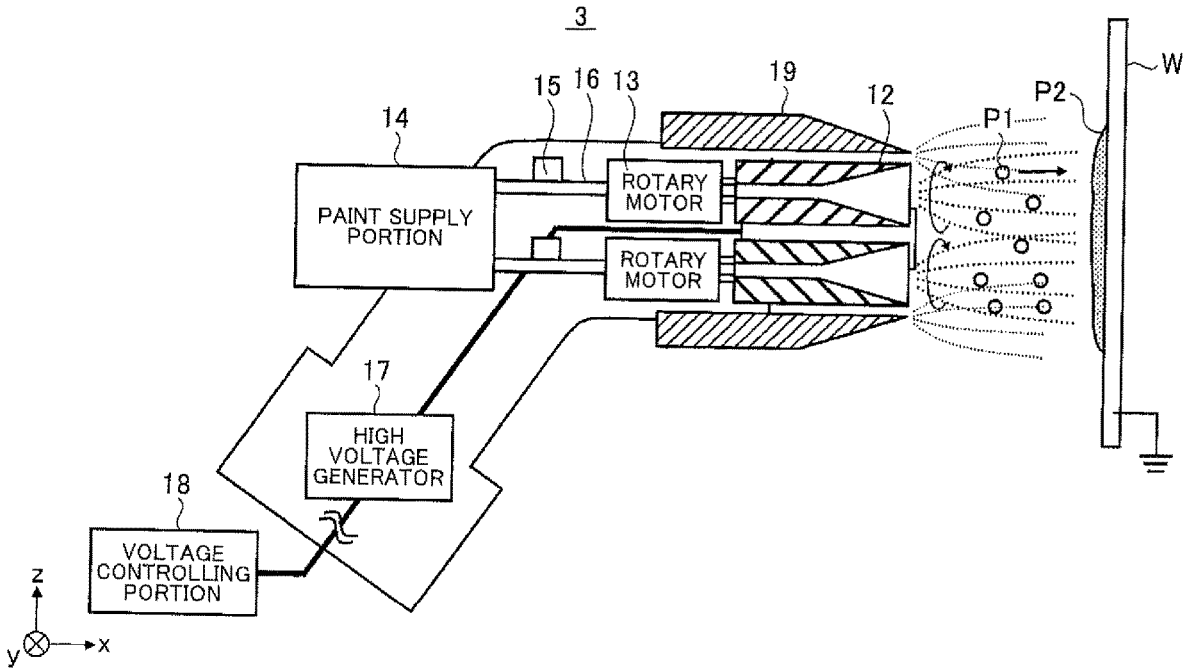
FIG. 18 is a sectional view schematically illustrating an electrostatic atomizing coating apparatus according to Embodiment 3.

FIG. 18 is a sectional view schematically illustrating an electrostatic atomizing coating apparatus 3 according to Embodiment 3. As compared with the electrostatic atomizing coating apparatus 2, the electrostatic atomizing coating apparatus 3 includes a plurality of rotary heads 12 placed in parallel with each other, instead of a single rotary head 12.

Further, a plurality of rotary motors 13 is provided to the plurality of rotary heads 12, respectively.

With the use of the plurality of rotary heads 12, the electrostatic atomizing coating apparatus 3 can improve a degree of freedom of a coating pattern and machining ability. The other configurations of the electrostatic atomizing coating apparatus 3 are the same as those of the electrostatic atomizing coating apparatus 2, so descriptions thereof are omitted.

As described above, the electrostatic atomizing coating apparatuses according to Embodiments 1 to 3 electrostatically atomize the paint P1 to a particle diameter suitable for the application by the electrostatic force in the electrostatic field formed between the rotary head and the workpiece W without using shaping air. Hereby, paint particles attached to the workpiece W and paint particles floating near the workpiece W are not raised up by an accompanied flow of the shaping air, thereby making it possible to improve the coating efficiency.

Further, the electrostatic atomizing coating apparatuses according to Embodiments 1 to 3 control the output voltage of the high voltage generator by use of the voltage controlling portion so that the current discharged from the open end of the rotary head is always constant. Hereby, even if the distance between the rotary head and the workpiece W changes, the potential difference V changes according to the change of the distance, so that fluctuations in the electric field intensity E are restrained. As a result, variations in the particle diameter of the paint P1 to be electrostatically atomized are restrained, so that the atomization of the paint P1 can be stabilized and the coating efficiency can be stabilized.

The disclosure is not intended to be limited to the above exemplary embodiments and various modifications can be made within a range that does not materially deviate from these embodiments. For example, the high voltage generator 17 and the voltage controlling portion 18 may be provided outside the electrostatic atomizing coating apparatuses 1 to 3.

Further, the above embodiments deal with an example in which the voltage controlling portion 18 controls the output voltage of the high voltage generator 17 so that the current discharged from the rotary head 12 is always constant, but the above embodiments are not limited to this. A measurement circuit for measuring the distance r between the rotary head 12 and the workpiece W may be further provided, so as to control the output voltage of the high voltage generator 17 based on a measurement result of the measurement circuit so that the electric field intensity E is constant.

It will be appreciated that the above-disclosed features and functions, or alternatives thereof, may be desirably combined into different compositions, systems or methods. Also, various alternatives, modifications, variations or improvements may be subsequently made by those skilled in the art. As such, various changes may be made without departing from the spirit and scope of this disclosure.

What is claimed is:

1. An electrostatic atomizing coating apparatus comprising:

at least one rotary head having a base portion, an open end and a plurality of grooves formed radially on an inner peripheral surface of the open end, an inside diameter of the rotary head increasing from the base portion toward the open end;

a motor configured to rotate the at least one rotary head to discharge a thread-shaped paint from the open end;

a generator configured to provide a voltage to the at least one rotary head so as to form an electrostatic field between the open end and a grounded coating target and electrostatically atomize the thread-shaped paint discharged from the open end;

a measurement circuit configured to measure a distance between the rotary head and the grounded coating target; and a controller configured to control a voltage output from the generator based on the measurement from the measurement circuit so as to provide a constant current flow between the rotary head and the grounded coating target to control a particle diameter of the electrostatically atomized thread-shaped paint, wherein the thread-shaped paint discharged from the open end of the rotary head is electrostatically atomized by an electrostatic force in the electrostatic field without shaping air, and the controller controls the voltage output while the distance between the rotary head and the grounded coating target changes in order to maintain the constant current flow, the change in distance being based on a change in shape of the grounded coating target.

2. The electrostatic atomizing coating apparatus according to claim 1, further comprising an outer ring configured to surround an outer peripheral surface of the at least one rotary head, wherein the voltage output from the generator is provided to the outer ring.

3. The electrostatic atomizing coating apparatus according to claim 2, wherein the outer ring comprises a base and a front end.

4. The electrostatic atomizing coating apparatus according to claim 3, wherein a sectional area of the outer ring perpendicular to an axial direction of the outer ring decreases from the base of the outer ring toward the front end.

5. The electrostatic atomizing coating apparatus according to claim 4, wherein a thickness of the front end is in the range of 0.3 mm to 1 mm.

6. The electrostatic atomizing coating apparatus according to claim 3, wherein a plurality of grooves are formed on an outer peripheral surface of the front end along the axial direction of the outer ring.

7. The electrostatic atomizing coating apparatus according to claim 3, wherein the outer ring further comprises a plurality of protruding portions projecting from the front end along the axial direction of the outer ring.

8. The electrostatic atomizing coating apparatus according to claim 1, wherein the apparatus comprises a plurality of rotary heads, and the plurality of rotary heads are provided in parallel with each other.

9. The electrostatic atomizing coating apparatus according to claim 1, wherein an outside diameter of the at least one rotary head is in the range of 20 mm to 50 mm.

10. The electrostatic atomizing coating apparatus according to claim 1, wherein a number of the plurality of grooves is in the range of 600 to 1,000.

11. The electrostatic atomizing coating apparatus according to claim 1, wherein the controller is configured to control the particle diameter of the electrostatically atomized thread-shaped paint when the particle diameter of the electrostatically atomized thread-shaped paint is in the range of 20 μm to 30 μm in terms of Sauter Mean Diameter.

12. The electrostatic atomizing coating apparatus according to claim 1, wherein the motor rotates the at least one rotary head at a speed in the range of 500 mm/s to 1,200 mm/s.

13. The electrostatic atomizing coating apparatus according to claim 1, wherein a glow discharge is generated from the open end of the rotary head.

14. The electrostatic atomizing coating apparatus according to claim 1, wherein an outer peripheral surface of the at least one rotary head has a circular column shape.

15. An electrostatic atomizing coating method comprising:

providing the electrostatic atomizing coating apparatus according to claim 1;

discharging the thread-shaped paint from the open end of the rotary head by rotating the rotary head;

electrostatically atomizing the thread-shaped paint discharged from the open end by forming the electrostatic field between the open end and the coating target;

measuring the distance between the rotary head and the grounded coating target; and controlling a current flowing between the rotary head and the grounded coating target based on the measurement to provide the constant current flow between the rotary head and the grounded coating target to control the particle diameter of the electrostatically atomized thread-shaped paint.

16. The electrostatic atomizing coating method according to claim 15, wherein an outer peripheral surface of the rotary head has a circular column shape.

17. An electrostatic atomizing coating apparatus comprising:

at least one rotary head having a base portion, an open end and a plurality of grooves formed radially on an inner peripheral surface of the open end, an inside diameter of the rotary head increasing from the base portion toward the open end;

a motor configured to rotate the at least one rotary head to discharge a thread-shaped paint from the open end;

a generator configured to provide a voltage to the at least one rotary head so as to form an electrostatic field between the open end and a grounded coating target and electrostatically atomize the thread-shaped paint discharged from the open end;

a measurement circuit configured to measure a distance between the rotary head and the grounded coating target; and a controller configured to control a voltage output from the generator based on the measurement from the measurement circuit so as to provide a constant current flow between the rotary head and the grounded coating target to control a particle diameter of the electrostatically atomized thread-shaped paint, wherein the thread-shaped paint discharged from the open end of the rotary head is electrostatically atomized by an electrostatic force in the electrostatic field without shaping air, the controller controls the voltage output while the distance between the rotary head and the grounded coating target changes in order to maintain the constant current flow, the change in distance being based on a change in shape of the grounded coating target, and a distance between the rotary head and the coating target is in a range of 50 to 100 mm.

* * * * *